US005269276A

United States Patent [19]

Brown

[11] Patent Number: 5,269,276

[45] Date of Patent: Dec. 14, 1993

[54] INTERNAL COMBUSTION ENGINE FUEL SUPPLY SYSTEM

[75] Inventor: Bradley Brown, Metamora, Mich.

[73] Assignee: Ford Motor Company, Dearborn, Mich.

[21] Appl. No.: 952,130

[22] Filed: Sep. 28, 1992

[51] Int. Cl.[5] ..... F02B 33/04; F02M 39/00

[52] U.S. Cl. ..... 123/514; 123/516

[58] Field of Search ..... 123/514, 516, 510

[56] References Cited

U.S. PATENT DOCUMENTS

| | | | |
|---|---|---|---|
| 1,189,479 | 7/1916 | Pfouts . | |
| 3,020,950 | 2/1962 | Schraivogel . | |
| 3,773,091 | 11/1973 | Boyd et al. . | |
| 4,142,470 | 3/1979 | Zauss . | |
| 4,187,813 | 2/1980 | Stumpp | 123/510 |
| 4,411,239 | 10/1983 | Kelch | 123/516 |
| 4,459,964 | 7/1984 | Straubel et al. | 123/514 |
| 4,504,885 | 3/1985 | Hall . | |
| 4,541,395 | 9/1985 | Geiger . | |
| 4,543,938 | 10/1985 | Szlaga | 123/514 |
| 4,582,039 | 4/1986 | Nishida | 123/514 |
| 4,589,395 | 5/1986 | Timms et al. | 123/514 |
| 4,625,701 | 12/1986 | Bartlett et al. | 123/510 |
| 4,732,131 | 3/1988 | Hensel | 123/516 |
| 4,747,388 | 5/1988 | Tuckey | 123/514 |
| 4,763,684 | 8/1988 | Kelch | 123/516 |
| 4,796,593 | 1/1989 | Woodcock et al. | 123/516 |
| 4,844,043 | 7/1989 | Keller | 123/516 |
| 4,876,993 | 10/1989 | Slattery | 123/516 |
| 4,893,674 | 1/1990 | Tuckey | 123/514 |
| 4,899,784 | 2/1990 | Woodgate et al. | 123/514 |
| 4,926,829 | 5/1990 | Tuckey | 123/514 |
| 4,928,657 | 5/1990 | Asselin | 123/514 |
| 4,986,318 | 1/1991 | Yun | 141/39 |
| 4,989,568 | 2/1991 | Sougawa | 123/73 AD |
| 4,989,572 | 2/1991 | Giacomazzi et al. | 123/514 |
| 5,014,742 | 5/1991 | Covert et al. | 137/588 |
| 5,035,223 | 7/1991 | Watanabe | 123/514 |
| 5,085,198 | 2/1992 | Bartlett et al. | 123/514 |
| 5,095,880 | 3/1992 | Ricks | 123/516 |
| 5,137,002 | 8/1992 | Mahoney et al. | 123/516 |
| 5,146,901 | 9/1992 | Jones | 123/514 |
| 5,148,792 | 9/1992 | Tuckey | 123/514 |

*Primary Examiner*—E. Rollins Cross
*Assistant Examiner*—Thomas Moulis
*Attorney, Agent, or Firm*—Jerome R. Drouillard; Roger L. May

[57] ABSTRACT

A fuel supply system for an internal combustion engine 10 includes a fuel tank 14, a pump 12 having an inlet 16 for receiving fuel from the tank, and an outlet 18 for transferring fuel to the engine. A fuel supply line 20 extends from the tank to the inlet of the pump, and a fuel return line 22 extends from the engine to the inlet of the pump such that fuel may be recirculated from the engine to the pump inlet without passing into the tank.

7 Claims, 1 Drawing Sheet

INTERNAL COMBUSTION ENGINE FUEL SUPPLY SYSTEM

BACKGROUND AND SUMMARY OF THE INVENTION

Many types of fuel systems used with both spark ignition and compression ignition internal combustion engines are configured such that fuel is constantly recirculated in a loop extending to and from the fuel tank and the engine. This recirculation can disadvantageously result in greatly increased fuel temperatures as the engine's heat is transferred to the recirculating fuel.

U.S. Pat. No. 4,989,572 to Giacomazzi et al. discloses a fuel plumbing arrangement intended to mitigate heat buildup in a fuel tank by returning the recirculated fuel to an in-tank reservoir containing the vehicle's fuel pump.

Although some benefit, in terms of lower fuel temperature, is claimed for the system of the '572 patent, the data contained therein show that improvement is generally not striking. In contrast, a system according to the present invention may be operated so as to eliminate any heating of the fuel in the fuel tank due to recirculation of fuel. Nevertheless, if heating is desired so as to avoid waxing on fuel filters during operation at very low ambient temperatures, or for other reasons, a system according to the present invention may be used to control the fraction of the total fuel flow which is returned to the tank. It is an advantage of the present invention that fuel tank temperature may be controlled by allowing some, all, or none of the fuel being returned from the engine to enter the fuel tank.

According to the present invention, a fuel supply system for an internal combustion engine includes a fuel tank, a pump having an inlet for drawing fuel from the tank and an outlet for transferring fuel to the engine. The pump receives fuel via a fuel supply line extending from the tank to the pump inlet. The fuel supply system also includes a fuel return line extending from the engine to the inlet of the pump such that fuel is recirculated from the engine to the pump inlet without passing into the tank. A fuel supply system according to the present invention may also incorporate an air separator positioned in the fuel return line, with the separator comprising means for removing air from the fuel flowing through the return line and means for diverting a fraction of the returned fuel, including the separated air, to the tank. A fuel supply system according to this invention may additionally include a variable flow restrictor positioned in the return line between the air separator and the pump inlet.

BRIEF DESCRIPTION OF THE DRAWING

The FIGURE contains a schematic representation of a fuel supply system according to the present invention.

DETAILED DESCRIPTION OF THE PREFERRED EMBODIMENTS

Figure 1:
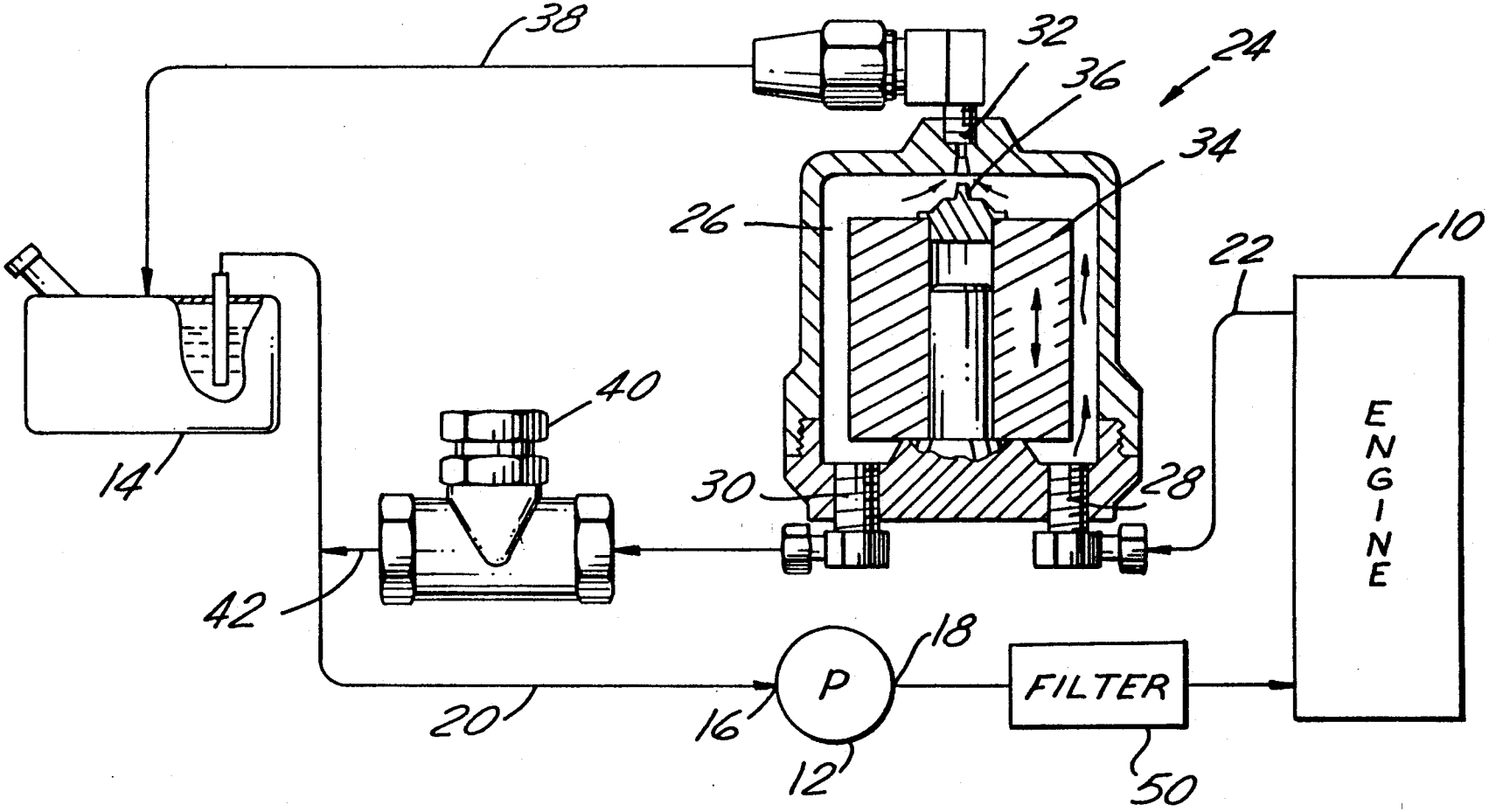

As shown in the FIGURE, an engine, 10, is supplied with fuel from a tank, 14, by means of a fuel pump, 12, having an inlet, 16, and an outlet, 18. Fuel moving to the engine returns from the engine via return line, 22. Return line 22, with its various components, allows fuel to be recirculated from the engine to the fuel pump's inlet without passing into tank 14.

Those skilled in the art will appreciate in view of this disclosure that a portion, if not all of, a fuel supply system according to this invention could be located either remotely from pump 12, or within the pump housing itself. Those skilled in the art will further appreciate that a system according to the present invention could be used with not only with fuel systems having multiple fuel pumps supplying unit injectors, but also with other types of gasoline and diesel fuel systems. For example, if a first, low pressure, transfer pump is used to feed a higher pressure Pump which in turn feeds unit injectors in a diesel fuel system, the present invention could be used to recirculate surplus fuel from the injectors to the inlet of the high pressure feed pump. Thus, a system according to the present invention includes a pump which receives fuel from the tank, either directly, or from an intermediate pump.

Beginning at fuel tank 14, fuel enters fuel supply line, 20, passes into pump 12 via inlet 16 and out of pump outlet 18 into engine 10. Returning from the engine, fuel enters return line 22 and passes ultimately to jumper line, 42, and then once again into supply line 20. Because pump 12 is continually drawing fuel from tank 14, fuel will not be allowed to backflow into tank 14 from fuel supply line 20. As a result, the fuel within tank 14 will not be heated by the returning fuel passing through return line 22.

Upon entering return line 22, fuel may pass through two optional devices according to the present invention. Accordingly, an air separator may be used in a system according to the present invention. Such a separator, 24, includes a float chamber, 26, having inlet port, 28, a lower outlet port, 30, and an upper outlet port, 32. The air separator comprises means for removing air from the fuel flowing through return line 22 and means for diverting a fraction of the returned fuel and separated air to the tank.

Fuel contaminated with air is allowed to move through upper outlet port 32 and then through tank line 38 to fuel tank 14. The movement of fuel and airthrough upper outlet port 32 is governed by float 34, which has a pintle 36 at its upper extremity, and which selectively occludes upper outlet port 32. When air enters air separator 24, the air will accumulate in the upper regions of float chamber 26, and eventually, when sufficient air has entered the float chamber, float 34 will drop, allowing the air and the fuel contaminated with air to be purged into fuel tank 14. Solid fuel—i.e., fuel which is not contaminated with air—will leave air separator 24 via lower outlet port 30 and move past optional pressure regulator 40 and through jumper line 42 to fuel supply line 20 and pump inlet 16. Those skilled in the art will appreciate in view of this disclosure that upper outlet port 32 of air separator 24 could function as a fixed orifice, so as to obviate the requirement for float 34. Such an arrangement would result in a substantially continuous flow through tank line 38, which could be desirable with certain types of fuel system installations.

As noted above, pressure regulator 40 may optionally be used in a system according to the present invention. Pressure regulator 40 permits the pressure within air separator 24 to be controlled so as to provide a force for moving air and fuel through tank line 38. In a simple form, pressure regulator 40 may comprise a fixed orifice. A more elaborate spring-loaded valve comprising any of the types known to those skilled in the art and suggested by this disclosure could be employed as an alternative to a fixed orifice.

If desired, pressure regulator 40 may be used as a variable flow restrictor responsive to a fuel system temperature, such as the temperature of the fuel in the tank, so as to control the relative portions of fuel either returned through tank line 38 to the tank, or passed through jumper line 42 directly to engine 10 without passing through the fuel tank. Accordingly, taken together, air separator 24, tank line 38, and pressure regulator 40 comprise an apparatus for recirculating fuel from engine 10 to fuel pump inlet 16 and tank 14 while functioning as a flow divider means for dividing the recirculated fuel into a first portion which is returned to the tank by means of tank line 38 and a second portion which is returned to fuel pump inlet 16 by means of jumper line 42 without flowing into tank 14. Because pressure regulator 40 may be made temperature responsive, the first and second portions may be determined according to a fuel system temperature, such as the temperature of the fuel flowing through the pressure regulator.

A common problem with diesel engines has to do with the formation of paraffin wax crystals in the fuel during operation at lower ambient temperatures. These crystals may cause fuel filters to become clogged, thereby impairing engine operation. A system according to the present invention will prevent such a problem if the filter is located between pump outlet 18 and the engine. Filter 50 in the FIGURE is located so that all of the warmed recirculating fuel will pass through the filter, thereby obviating any potential filter plugging due to wax formation. Those skilled in the art will appreciate in view of this disclosure that filter 50 could alternatively be located on the suction side of pump 12, it only being necessary that the filter be located between the fuel return apparatus and the engine.

I claim:

1. A fuel supply system for an internal combustion engine, comprising:

a fuel tank;

a pump having an inlet for receiving fuel from the tank and an outlet for transferring fuel to the engine;

a fuel supply line extending from said tank to the inlet of said pump;

a fuel return line extending from said engine to the inlet of the pump such that fuel is recirculated from the engine to the pump inlet without passing into the tank, and an air separator positioned in said fuel return line, with said separator comprising means for removing air from the fuel flowing through the return line and means for diverting a fraction of the returned fuel, including the separated air, to the tank whereby heating of the fuel in the tank by returned fuel will be minimized, and wherein said air separator comprises a float chamber having an inlet port for fuel flowing from the engine, a lower outlet port for solid fuel, with said lower outlet port being connected with the pump inlet, and an upper outlet port for fuel containing air, with said upper outlet port being connected with the main volume of the fuel tank, with the upper outlet port being selectively occluded by a float which is contained in the chamber and which is buoyed by the fuel flowing through the separator such that the upper outlet port will be occluded by the float whenever the fuel flowing in the return line is substantially free of air.

2. A fuel supply system according to claim 1, wherein said air separator comprises a chamber having an inlet port for fuel flowing from the engine, a lower outlet port for solid fuel, with said lower outlet port being connected with the pump inlet, and an upper outlet port, comprising a fixed orifice, for fuel containing air, with said upper outlet port being connected with the main volume of the fuel tank.

3. A recirculating fuel supply system for an internal combustion engine, comprising:

a fuel tank;

a pump mounted externally to be tank and having an inlet for receiving fuel from the tank and an outlet for transferring fuel to the engine;

a fuel supply line extending from said tank to the inlet of said pump;

a fuel return line extending from the engine to a fuel return apparatus; and a fuel return apparatus for recirculating fuel from the engine to both the fuel pump inlet and to the tank, with said return apparatus comprising a flow divider means for dividing the recirculated fuel into a first portion which is returned to the tank by means of a tank line, and a second portion which is conducted to the fuel pump inlet by means of a jumper line, without flowing into the tank, wherein said flow divider means is responsive to an operating temperature of the fuel supply system, such that the relative mangnitudes of the first and second portions will be determined according to such temperature, whereby heating of the fuel in the tank by returned fuel will be minimized.

4. A recirculating fuel supply system according to claim 3, wherein said flow divider means comprises a thermally responsive pressure regulator positioned in the inlet line.

5. A recirculating fuel supply system according to claim 3, wherein said fuel return apparatus further comprises an air separator means for purging air from fuel flowing through the return line and for combining the purged air with the first portion of fuel.

6. A fuel supply system according to claim 3, further comprising a fuel filter interposed between said fuel return apparatus and said engine such that all of the fuel flowing through said fuel return apparatus passes through said filter.

7. A fuel supply system according to claim 3, further comprising a fuel filter interposed between said pump outlet and said engine.

* * * * *